US006363855B1

(12) United States Patent
Kim et al.

(10) Patent No.: US 6,363,855 B1
(45) Date of Patent: Apr. 2, 2002

(54) SOLID PROPELLANT ROCKET MOTOR THERMALLY INITIATED VENTING DEVICE

(75) Inventors: Steven S. Kim, Crofton; Chris M. Nugent, Bel Alton, both of MD (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 0 days.

(21) Appl. No.: 09/697,244

(22) Filed: Oct. 27, 2000

(51) Int. Cl.[7] ..... F41A 9/00

(52) U.S. Cl. ..... 102/481; 102/378; 60/223; 60/253; 60/254

(58) Field of Search ..... 102/374, 378, 102/481; 60/223, 253, 254

(56) References Cited

U.S. PATENT DOCUMENTS

| | | | | | |
|---|---|---|---|---|---|
| 3,134,222 | A | * | 5/1964 | Maxson | 102/378 |
| 3,173,364 | A | | 3/1965 | Nordzell | 102/1 |
| 3,971,290 | A | * | 7/1976 | Blain | 102/378 |
| 4,084,512 | A | | 4/1978 | San Miguel | 102/103 |
| 4,478,151 | A | | 10/1984 | Vetter et al. | 102/481 |
| 4,597,261 | A | * | 7/1986 | Dolan | 60/223 |
| 4,709,637 | A | * | 12/1987 | Bogguo | 102/481 |
| 5,129,326 | A | | 7/1992 | Brogan | 102/481 |
| 5,166,468 | A | * | 11/1992 | Atkeson | 102/481 |
| 5,466,537 | A | | 11/1995 | Diede et al. | 428/548 |
| 5,786,544 | A | | 7/1998 | Gill et al. | 102/481 |
| 5,813,219 | A | | 9/1998 | Gill et al. | 60/223 |
| 6,148,729 | A | * | 11/2000 | Smith et al. | 102/378 |

* cited by examiner

*Primary Examiner*—Harold J. Tudor
(74) *Attorney, Agent, or Firm*—Mark Homer

(57) ABSTRACT

An ordnance venting system has a thermally initiated rapid deflagrating composition that detonates a high energy material. The high energy material is configured as a shaped charge and surrounds the ordnance housing of a rocket motor. During cook-off of the munition, the high energy material detonates, rupturing the structural integrity of the ordnance housing sufficiently to release pressure therefrom.

6 Claims, 1 Drawing Sheet

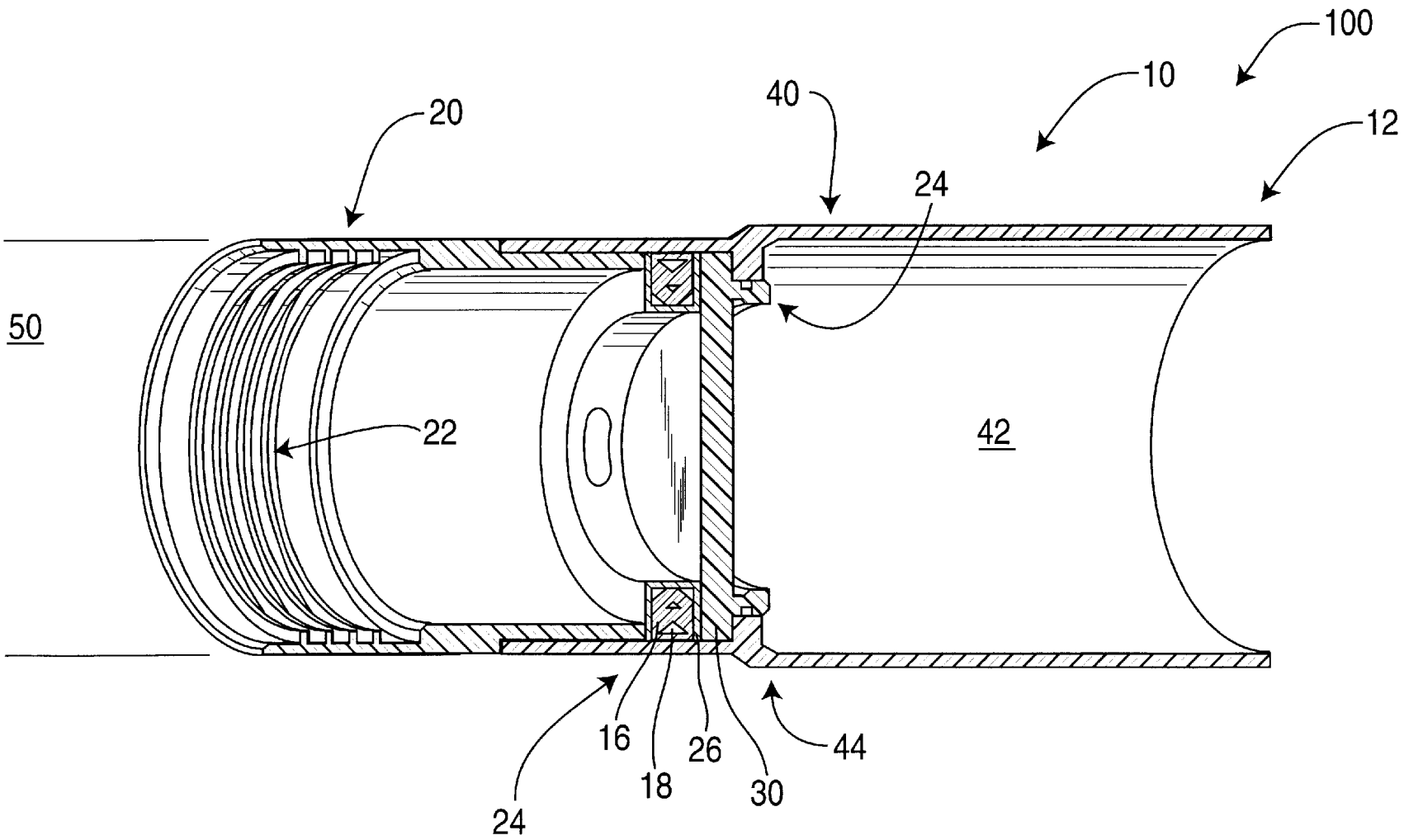
100
12
10
42
24
40
44
30
26
18
16
24
20
22
50

SOLID PROPELLANT ROCKET MOTOR THERMALLY INITIATED VENTING DEVICE

The invention described herein may be manufactured and used by or for the government of the United States of America for governmental purposes without the payment of any royalties thereon or therefor.

BACKGROUND OF THE INVENTION

1. Field of the Invention

The present invention relates to rocket motors. More particularly, the rocket motor of the present invention includes an ordnance venting system to reduce the danger of explosion for heat induced over-pressurization. Most particularly, the ordnance venting system has a high energy material that detonates prior to rocket cook-off to prevent cook-off. The high energy material is attached to a deflagrating composition through a transition booster sleeve to initiate detonation at a given temperature.

2. Brief Description of the Related Art

The MK 66 Rocket Motor is a 2.75-Inch diameter weapon system used by the United States armed services. Stringent cook off requirements improve safety to personnel and property in the event that an ordnance system is initiated by excess heat. The MK 66 Rocket Motor is stored and operated from land and sea.

Several patents disclose munition venting systems. U.S. Pat. No. 3,173,364 (Nordzell) discloses a detonating charge that will be ignited causing a top charge to detonate thereby opening the top of a projectile and causing the shell of a projectile to burst before the main charge is detonated. U.S. Pat. No. 4,084,512 (San Miguel) discloses thermally conductive plugs within a rocket motor casing that facilitates local combustion allowing the ignited fuel to quickly burn through the casing wall and vent internal pressure. U.S. Pat. No. 4,478,151 (Vetter, et al.) discloses a thermite mass with a small quantity of igniter compound that causes the hull to melt permitting the propellant grain to vent. U.S. Pat. No. 5,129,326 (Brogan) discloses a solid mass affixed to the ordnance device shell with the solid mass comprised of an ignition mix and a main mix that is ignited by the ignition mix. The solid mass generates sufficient heat to weaken the structure of the shell and allow venting. U.S. Pat. No. 5,466,537 (Diede, et al.) discloses a thermal pellet that is ignited with the burning pellet igniting an explosive material. U.S. Pat. No. 5,786,544 (Gill, et al. '544) discloses pyrotechnical thermal pellets that ignite adjacent to vent holes. U.S. Pat. No. 5,813,219 (Gill, et al. '219) discloses a pyrotechnical thermal pellet that ignites and activates the rocket motor igniter pellets which soften a resin and fiber casing of the rocket motor.

Although the identified patents disclose several types of explosive/thermal missile venting devices, none of the patents disclose an non-complex reliable pressure released device that improves the MK 66 rocket motor's response to insensitive munition (IM) threats, such as fast cook-off, slow cook-off, bullet impact, fragment impact and sympathetic detonation. The present invention addresses this and other needs.

SUMMARY OF THE INVENTION

The present invention includes an ordnance venting system to reduce the danger of explosion from heat induced over-pressurization comprising a thermally initiated rapid deflagrating composition proximate to the ordnance housing, wherein the deflagrating composition is affected by equivalent temperatures within the ordnance housing, wherein the deflagrating composition deflagrates at high temperature and a high energy material detonationally attached to the thermally initiated rapid deflagrating composition, the high explosive circumferentially surrounding the ordnance housing between the warhead end and rocket motor end, wherein the high energy material is capable of rupturing the structural integrity of the ordnance housing sufficient to release pressure therefrom.

The present invention also includes an ordnance venting rocket system to reduce the danger of explosion from heat induced over-pressurization comprising an ordnance housing having a warhead end and rocket motor end, a thermally initiated rapid deflagrating composition proximate to the ordnance housing, wherein the deflagrating composition is affected by equivalent temperatures within the ordnance housing, wherein the deflagrating composition deflagrates at high temperature and a high explosive detonationally attached to the thermally initiated rapid deflagrating composition, the high explosive circumferentially surrounding the ordnance housing between the warhead end and rocket motor end, wherein the high explosive is capable of rupturing the structural integrity of the ordnance housing sufficient to release pressure therefrom.

Additionally, the present invention includes a method of venting an ordnance device, comprising the steps of providing an ordnance venting rocket system to reduce the danger of explosion from heat induced over-pressurization comprising an ordnance housing having a warhead end and rocket motor end, a thermally initiated rapid deflagrating composition proximate to the ordnance housing, wherein the deflagrating composition is affected by equivalent temperatures within the ordnance housing, wherein the deflagrating composition deflagrates at high temperature and a high energy material detonationally attached to the thermally initiated rapid deflagrating composition, the high energy material circumferentially surrounding the ordnance housing between the warhead end and rocket motor end, wherein the high energy material is capable of rupturing the structural integrity of the ordnance housing sufficient to release pressure therefrom, and deflagrating the deflagrating composition at a predetermined temperature, wherein detonating of the high energy material occurs sufficient to release the pressure from within the ordnance housing.

Furthermore, the present invention includes a vented ordnance device product produced from the method comprising the steps of providing an ordnance venting rocket system to reduce the danger of explosion from heat induced over-pressurization comprising an ordnance housing having a warhead end and rocket motor end, a thermally initiated rapid deflagrating composition proximate to the ordnance housing, wherein the deflagrating composition is affected by equivalent temperatures within the ordnance housing, wherein the deflagrating composition deflagrates at high temperature and a high energy material detonationally attached to the thermally initiated rapid deflagrating composition, the high energy material circumferentially surrounding the ordnance housing between the warhead end and rocket motor end, wherein the high energy material is capable of rupturing the structural integrity of the ordnance housing sufficient to release pressure therefrom, and deflagrating the deflagrating composition at a predetermined temperature, wherein detonating of the high energy material occurs sufficient to release the pressure from within the ordnance housing.

The present invention is particularly useful for the United States Navy's MK 66 Rocket.

BRIEF DESCRIPTION OF THE DRAWING

FIG. 1 illustrates the MK 66 Rocket Motor with the ordnance venting system of the present invention.

DETAILED DESCRIPTION OF THE PREFERRED EMBODIMENT

The present invention improves Insensitive Munitions (IM) performance of the MK 66 Rocket Motor, by providing a cook-off pressure release mechanism which prevents deflagration and/or propulsive reaction to fuel fire/cook-off situations. The present invention causes the motor tube of a rocket motor to forward vent prior to cook-off to mitigate and/or prevent deflagration and/or propulsive reaction and over pressurization within the motor tube. The motor tube venting occurs by a release of the warhead adapter and vent covering which is released by a shaped charge installed along the inside of the motor tube. The shaped charge detonates to fracture the area of the warhead adapter to cause venting at high temperatures, thereby providing increased safety to property and personnel by mitigating the rocket motor's reaction to Insensitive Munitions (IM) stimuli. The present invention may be incorporated into any suitable rocket motor, particularly solid propellant rocket motor systems such as the MK 66 Rocket Motor, as well as to commercial launch vehicles and industrial applications which require emergency venting of high pressure systems.

Referring to FIG. 1, an ordnance venting system 10 of the present invention is shown. The ordnance venting system 10 includes a MK 66 Rocket Motor or other suitable rocket motor 12 having warhead adapter 20 pressing or otherwise securing a vent covering 30 onto a motor tube 40. On the opposite side of the warhead adapter 20 from the motor tube 40, a warhead 50 is attached. The ordnance venting system I 0 prevents a propulsive reaction and over pressurization within a rocket motor tube 40 using a deflagrating composition 18 that burns at a given temperature which then detonates a high energy material 16 through a transition booster sleeve 26 prior to rocket 100 cook-off. With the detonation of the high energy material 16, the rocket motor 12 vents the rocket motor reactants forward, which may be in addition to venting through the nozzle of the rocket 100. This forward venting improves IM performance of the rocket motor 12 by providing a reliable cook-off pressure release mechanism.

The warhead adapter 20 of the present invention presses against the vent covering 30, forcing the vent covering 30 to cover a venting area formed by the motor tube 40. The warhead adapter 20 attaches the motor tube 40, with proper attachment determinable by those skilled in the art, such as a screw mechanism or a recessed area that intermeshes with warhead adapter 20 threads 24 with extending edges into the inside of the formed vent opening. With the attachment of the warhead adapter 20, the motor tube 40 is sealed, i.e., covered, by the vent covering 30. Preferably the warhead adapter 20 comprises a thermoplastic composition and directly contacts the vent covering 30 for increasing the simplicity and reliability of the system. This contact preferably is along the outer edge of the vent covering 30 which is pressed in a ring imprint from the thermoplastic warhead adapter 20. The vent opening of the motor tube 40 is configured to provide a large opening for immediate and rapid venting of the propellant 42 during cook-off. At the forward end 44 of the motor tube 40, the formed venting area allows energized propellant 42 to be released or expelled without activation of the rocket motor 12. The vent covering 30 fits onto and completely seals this venting area of the motor tube 40, i.e., the vent covering 30 retains a physical seal on the venting area without structural or chemical bonding between the vent covering 30 and forward end 44 of the motor tube 40. The vent covering 30 seals a venting area formed at the forward end 44 of the motor tube 40. Preferably, the vent covering 30 comprises a singular piece formed as a circular structure with a diameter larger than the diameter of the venting area formed at the forward end 44 of the motor tube 40. Additional fitting grooves, extensions, or other like modifications may be incorporated into the vent covering 30, with the type of modification to the vent covering 30 determinable by those skilled in the art. Between the warhead adapter 20 and motor tube 40, and adjacent to the vent covering 30, the high energy material 16 is position connected to the deflagrating composition 18 through the transition booster sleeve 26 to react to temperatures sufficiently below the cook-off temperature of the propellant 42. The detonation of the high energy material allows the warhead adapter 20 significantly weakens and fractures the connection area 24 of the vent covering 30, warhead adapter 20 and motor tube 40. This permits the area to structurally fail prior to cook-off and release propellant 42 from the motor tube 40 through the venting area (vent opening) formed in the motor tube 40.

On the opposite side of the vent covering 30 from the motor tube 40, the warhead adapter 20 attaches the warhead 50 onto the motor tube 40, with proper attachment determinable by those skilled in the art, such as a threading or screw mechanism 22 or other like means.

The high energy material or high explosive 16 comprises any suitable explosive having sufficient power to fracture the connection area 24 for pressure release. The high energy material 16 encircles or circumferentially surrounds the ordnance housing 14 between the warhead adapter 20 and motor tube 40, and is formed into a shaped charge to focus the force of detonation to the shell of the ordnance housing 14, for effective fracture thereto and to aid in fracturing the connection area 24. As the shaped charge high energy material 16 is positioned adjacent to the vent covering 30, the fracturing of the connection area 24 dislocates the vent covering 30, allowing pressure release. The high energy material 16 is detonationally attached to the deflagrating composition 18. On detonation, the high energy material 16 ruptures the structural integrity of the ordnance housing or casing 14 sufficiently to release pressure therefrom. Preferably, the high energy material is either flexible linear shaped charge (FLSC) manufactured by Government manufacturers such as Sandia National Laboratory or mild detonating cord manufactured by Government manufacturers such as Sandia National Laboratory. Preferably, the high energy material 16 is configured to equally distribute from about 0.3 ounces to about 0.5 ounces of explosive in a "V" shape, positioned inward.

The deflagrating composition 18 comprises any suitable burning composition having sufficient power to cause detonation of the high energy material 16 through the transition booster sleeve 26. The deflagrating composition 18 is connected to the high energy material 16 through the transition booster sleeve 26. The deflagrating composition 18 is positioned proximate to the motor tube 40 sufficiently to become thermally initiated with increased temperatures of the motor tube 40. The deflagrating composition deflagrates at any suitable predetermined high temperatures, which energizes the transition booster sleeve 26, and detonates the high energy material 16. The deflagrating composition 18 preferably deflagrates at a temperature of from about 210° F. to about 240° F., with a more preferably temperature range of from about 220° F. to about 230° F. Preferably, the thermally initiated rapid deflagrating composition 18 comprises rapid deflagrating cord manufactured by Government manufacturers such as Sandia National Laboratory. The transition booster sleeve 26 comprises any suitable composition for detonation of the high energy material 16. Within the MK 66 Rocket Motor, the formed vent opening preferably comprises a diameter of approximately 1.9 inches and the warhead adapter 20 preferably comprises a diameter of approximately 2.4 inches. The length of the warhead adapter 20 is approximately 2.5 inches. The preferred deflagration temperature of the deflagrating composition 18 ranges from about 210° F. to about 240° F.

Within the MK 66 Rocket Motor, the formed vent opening preferably comprises a diameter of approximately 1.9 inches and the warhead adapter 20 preferably comprises a diameter of approximately 2.4 inches. The length of the warhead adapter 20 is approximately 2.5 inches. The preferred deflagration temperature of the deflagrating composition 18 ranges from about 210° F. to about 240° F.

The present invention includes a method for venting the ordnance device 10 which provides the ordnance venting system 10, previously described, and exposing the ordnance venting system 10 to a heated environment having sufficient temperature elevation to deflagrate the deflagrating composition 18 at a predetermined temperature. With the deflagration of the deflagrating composition 18, the transition booster sleeve 26 is initiated, causing the detonation of the high energy material 16. This unseats the vent covering 30 from sealing or covering the vent opening in the motor tube 40 and the pressure within the motor tube 40 has a passage to escape from the confines of the motor tube 40 which reduces the danger of explosion from heat induced over-pressurization. As pressure within the motor tube 40 increases the vent covering 30 becomes increasingly more removed from the vent opening, allowing increasing amounts of pressure to discharge from inside of the motor tube 40 in a rapid and efficient manner.

In operation, the vent opening within the motor tube 40 is sealed with the vent covering 30 which is fitted onto the formed vent opening. The warhead adapter 20 is fitted against the vent covering 30 on the opposite side of the motor tube 40 and connected sufficiently to the motor tube 40 of the rocket motor 12 to retain the vent covering 30 against the formed vent opening. When the ordnance venting system 10 is exposed to sufficiently high temperatures, detonation of the high energy material 16 occurs at a predetermined temperature to effectively break the structural integrity sufficiently to release the vent covering 30 with increased pressures within the motor tube 40. As the pressure within the motor tube 30 increase, the vent covering 30 becomes increasingly displaced from sealing the vent opening while allows greater pressure release from the motor tube 30. Displacement or ejection pressures preferably comprise a pressure of from about 5% to about 15% of the maximum expected operating pressure of the ordnance device, with the most preferred displacement or ejection pressure being approximately 5% of the maximum expected operating pressure of the ordnance device. Once the ordnance venting system 10 reduces the danger of explosion from heat induced over-pressurization, and the pressure becomes released from the motor tube 40, the vented ordnance device poses a significantly reduced threat to personnel and property with a reduced danger of explosion from heat induced over-pressurization.

EXAMPLE 1

Feasibility testing was conducted on concept prototype of the present invention devices in MK 66 motor tube hardware. This testing involved 3 functional firings of representative high energy material devices incorporating lead-sheathed FLSC to assess overall ability of adequately vent the motor case. The FLSC was assembled with the other motor parts in the configuration shown in FIG. 1. The FLSC successfully fractured the motor tube surrounding the FLSC and detached the warhead adapter and vent covering.

The ordnance venting system reduces the danger of explosion from heat induced over-pressurization by detonating a shaped charge during cook-off, which releases the vent covering to vent the motor tube. This vents propellant retained within the motor tube during cook-off of the rocket motor. The present invention has minimal complexity and may be retrofitted to existing MK 66 rocket motors without affecting ballistic performance. Additionally, the present invention does not require a safe/arm device or firing mechanism and uses existing linear explosive products.

The foregoing summary, description, examples and drawings of the invention are not intended to be limiting, but are only exemplary of the inventive features which are defined in the claims.

What is claimed is:

1. An ordnance venting system to reduce the danger of explosion from heat induced over-pressurization, comprising:

a rocket motor tube;

a warhead adapter cover;

a connection area wherein the rocket motor tube attaches to the warhead adapter cover;

a vent covering, having an outer edge, to cover a venting area formed by the rocket motor tube wherein the outer edge is proximate to the warhead adapter cover;

a booster sleeve, located circumferentially within the rocket motor tube proximate to the vent covering and the connection area;

a high energy material within the booster sleeve; and, a deflagrating composition within the booster sleeve for initiating the high energy material upon deflagration, wherein, upon initiation, the high energy material fractures the connection area to unseat the vent covering and allow venting pressure through the venting area.

2. The ordnance venting system of claim 1, wherein the high energy material comprises a shaped charge.

3. The ordnance venting system of claim 2, wherein the high energy material comprises a flexible linear shaped charge.

4. The ordnance venting system of claim 1, wherein the warhead adapter cover comprises a thermoplastic composition.

5. The ordnance venting system of claim 1, wherein the deflagrating composition deflagrates at a temperature of from about 210° C. to about 240° C.

6. The ordnance venting system of claim 5, wherein the deflagrating composition deflagrates at a temperature of from about 220° C. to about 230° C.

* * * * *